United States Patent [19]

Bauer et al.

[11] 4,143,583

[45] Mar. 13, 1979

[54] REDUNDANT EHV FAULT DETECTOR

[75] Inventors: Dan O. Bauer, Portage; Richard P. Heintz, Kalamazoo, both of Mich.

[73] Assignee: Pneumo Corporation, Boston, Mass.

[21] Appl. No.: 835,993

[22] Filed: Sep. 23, 1977

[51] Int. Cl.[2] ..... F15B 13/06

[52] U.S. Cl. ..... 91/1; 91/509; 60/328; 60/403; 244/195

[58] Field of Search ..... 91/1, 411 A; 60/327, 60/328, 403, DIG. 5, DIG. 2; 137/83; 244/194, 195

[56] References Cited

U.S. PATENT DOCUMENTS

| | | | |
|---|---|---|---|
| 3,095,783 | 7/1963 | Flindt | 91/1 |
| 3,987,702 | 10/1976 | Boss et al. | 91/1 |

*Primary Examiner*—Edgar W. Geoghegan
*Attorney, Agent, or Firm*—Maky, Renner, Otto & Boisselle

[57] ABSTRACT

Plural servo actuators are coupled to provide a redundant system for operating a common output device. Each servo actuator has plural servo valves each having one active output that causes controlled opposite operation of the output device and one passive output. A fault detector coupled to each servo actuator compares the sum of the passive output pressures with the pressures of two other fluid signals, in one case the supply and return fluid signals and in another case the two active output signals of the servo valves, to detect the condition thereof. A convenient checkout system and a fluid by-pass mechanism also are provided in the fault detector.

27 Claims, 2 Drawing Figures

S. O. V.
83
86
80
94
91
87
89
95
96
98
81
97
C1
103
99
105
92
93
100
C2
104
82
101
C'
106
107
102
84
107
120
104
111
110
121
122
112
113
114
127
125
126
87
89
LVDT.
116
A4
115
A5
116
A6
A8
A7
90
88
103
108
109
87
85

REDUNDANT EHV FAULT DETECTOR

BACKGROUND OF THE INVENTION

The present invention relates generally to fluid servo systems and, more particularly, to fault detectors for redundant hydraulic servo systems.

Fluid controls, such as servo systems are used for many purposes, one being, for example, to position flight control surfaces of an aircraft. In such an application redundant servo systems, including plural similar servo actuators, for example of the electro hydraulic type, may be employed to assure proper position control of the output device in case of a failure of one of such servo actuators, thus increasing the mechanical reliability of the aircraft. Such plural redundant servo actuators may be operated on a continuous simultaneous basis or on an alternate basis, with conventional electronic controls being available to select the operating mode and to control energization, normal operation and shut down of the respective servo actuators.

The health or condition of the electrical and hydraulic portions of a multiple channel servo actuator should be assessed on a continuous basis. Various types of electronic monitors are available to monitor such electrical portions. The present invention, though, is directed to the detection of faults in the hydraulics or other operating fluids of a servo system, more particularly, of a redundant servo system.

PRIOR ART STATEMENT

One prior art reference, U.S. Pat. No. 3,987,702, which is believed possibly to be material to the examination of this application, discloses a device in which electro hydraulic control of an hydraulic actuator is provided by plural parallel connected EHV's (electro hydraulic valve). The same sign output ports (hereinafter active outputs or active output ports in that the active fluid signal output therefrom has an active effect on an output device) from each of plural EHV's are parallelly connected to one side of a control spool output device to control the positioning of the latter in opposition to the hydraulic fluid pressure supply for the overall system. Such patent recognizes that both hydraulic output signals of an EHV vary with respect to each other and, therefore, that the condition of the EHV's, i.e. whether or not there is a fault, can be detected by monitoring the so-called passive outputs — those not directly operable on the output device. However, fault detection is provided in such patented device by a direct opposition comparison of the passive fluid output signals from the EHV's, which are applied to oppositely facing lands of a sensing spool.

Such fault detection mechanism, which only monitors truly parallelly connected EHV's, is not responsive to a change of system pressure relative to the passive hydraulic output signals and may be relatively slow acting especially when the input pressures are low. Also, check-out of the system operability is complicated because the sensing spool normally is balanced in a neutral position by the monitored pressures, when on, or by a spring, when the pressure is off. Moreover, undesirable failure transients may occur due to delays in detecting the necessary failure pressure differential and subsequent shut-down of one of plural redundant servo systems.

SUMMARY OF THE INVENTION

In accordance with the present invention the condition of a multiple channel servo actuator system is monitored by a modified comparison technique. Two EHV's, each of which has an input port, an active output port and a passive output port, the fluid flow between the input and respective outputs being determined by electrical fluid control signals delivered thereto, are electrically and fluidically coupled for parallel energization and operation. However, the active output ports of the EHV's are oppositely signed ones whereby in response to the same electrical signal input the fluid flow to one of such ports will increase while that to the other such port will decrease; accordingly each EHV represents a separate channel of the servo actuator. The active output port from the first EHV is coupled to an output device to cause movement thereof in one direction and the active output port from the second EHV also is coupled to the output device to cause movement thereof in the relatively opposite direction. The two respective passive output ports of the EHV's are combined to deliver to the fault detector a combined passive, i.e. doing no work on the output device, hydraulic fluid output signal (C'). Those passive output ports, therefore, also are of opposite sign response so that the combined passive signal C' ordinarily will remain relatively constant, varying only with the input hydraulic fluid supply pressure, when the EHV's are properly operating.

One aspect of the invention features the comparison of the pressure of such combined passive signal with the pressures of the hydraulic fluid supply signal (hereinafter supply signal), and of the hydraulic return fluid signal (hereinafter return signal). Check out of the fault detector system is facilitated in this embodiment, for the sensor spool of the comparison fault detector is forced to a hard-over position when the system shut-off valve is de-energized to cut off supply signal flow to the EHV's.

Another aspect of the invention features the comparison of the pressure of such combined passive signal with the pressures of the respective active output signals $C_1$ and $C_2$ from the EHV's. In this case a check-out piston causes a failure indication when the system shut-off valve is de-energized.

In both embodiments a detented spring provides a threshold force level representing a minimum pressure or force differential to obtain a failure indication, for example, by a conventional linear variable differential transformer (LVDT). Moreover, in accordance with another feature of the invention the fault detector, upon sensing a fault condition, bypasses one faulty high pressure active output signal from one EHV to the active output line of the other EHV thereby minimizing failure transients in the servo system and eliminating the need for bypass valving required in prior EHV servo systems.

The fault detector of the invention is particularly useful in redundant hydraulic servo actuator systems, for in operating in the passive legs of the EHV's it does not affect the dynamic performance of the servo actuator system or the output device controlled thereby. Moreover, the detector is uncomplicated and relatively inexpensive while at the same time being very reliably effective. Also by effecting comparison between a relatively constant pressure of the combined passive signal C' with other system signals, the fault detector of the invention is faster acting than the detector of, for example, the U.S. Pat. No. 3,987,702 patent above.

With the foregoing in mind, it is a primary object of the invention to detect a failure of a servo valve, such as an EHV, and, additionally, to provide an electrical indication thereof.

Another object is to announce a failed-closed shut-off valve of a multiple channel servo actuator system.

An additional object is to provide prompt detection of an EHV failure in a multiple channel servo system and preferably to provide such detection without affecting the dynamic performance of such system.

Still another object is to facilitate check-out of a fault detector in a servo actuator system.

Still an additional object is to reduce failure transients in a servo actuator system and to eliminate the need for bypass valving to handle excessive failure pressures in an EHV system.

Another primary object of the invention is to provide the foregoing features in a redundant servo actuator system.

These and other objects and advantages of the present invention will become more apparent as the following description proceeds.

To the accomplishment of the foregoing and related ends, the invention, then, comprises the features hereinafter fully described in the specification and particularly pointed out in the claims, the following description and the annexed drawings setting forth in detail certain illustrative embodiments of the invention, these being indicative, however, of but several of the various ways in which the principles of the invention may be employed.

DESCRIPTION OF THE PREFERRED EMBODIMENTS

Figure 1:
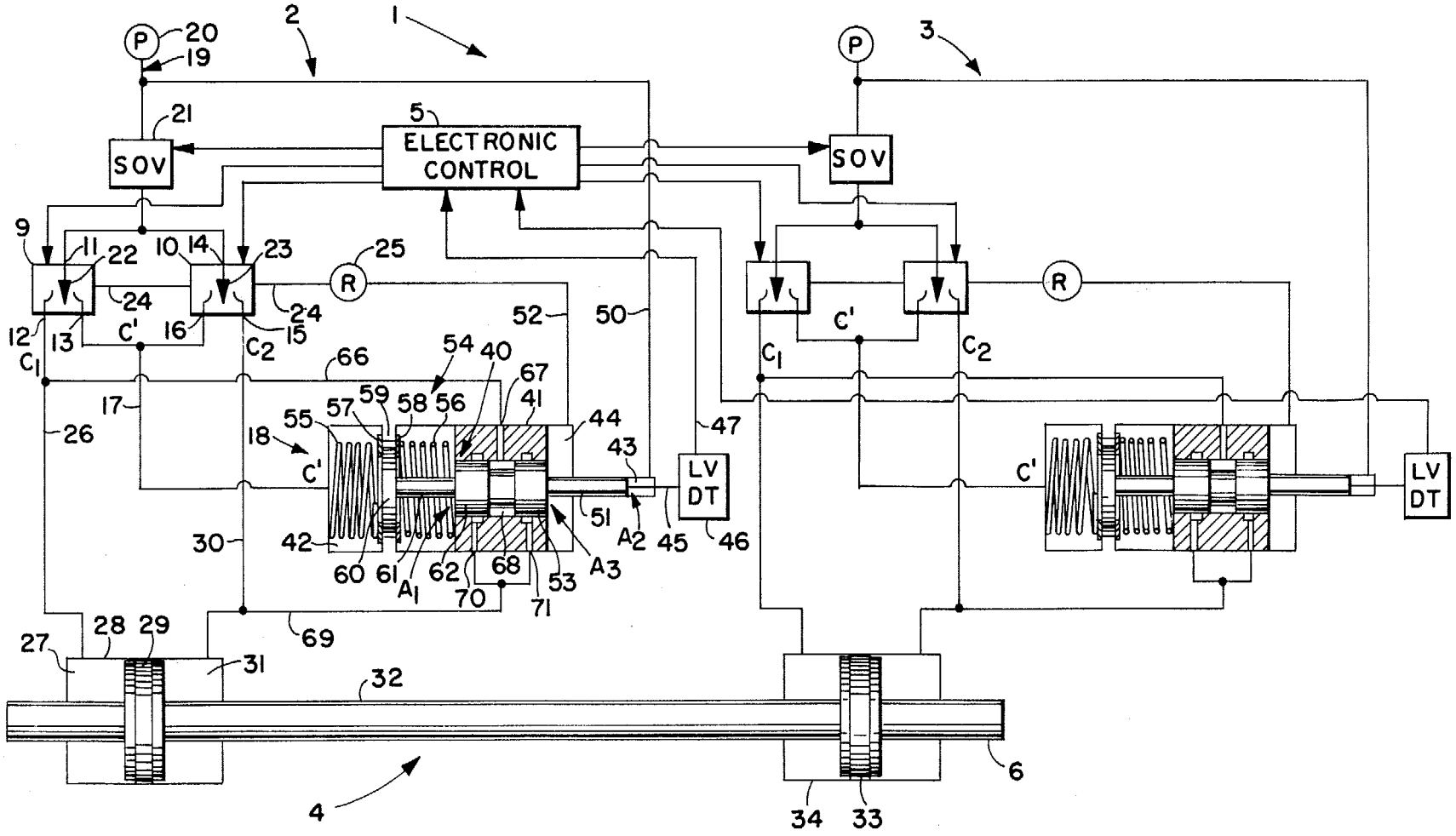
FIG. 1 is a schematic fluid and electrical circuits diagram of a redundant multiple channel servo actuator system including a fault detector.

Referring in detail to FIG. 1, a redundant multiple channel servo actuator system is generally indicated at 1 including two similar servo actuators 2, 3. The servo actuators 2, 3 are coupled to a common output device 4 and are operable in response to electrical signals produced by a conventional electronic control 5 to effect position control of such output device, which is in turn connected by an output rod 6 to an external device, not shown, to effect similar position control thereof. Such external device may be, for example, a flight control surface of an aircraft, and the two servo actuators in the overall system provide a redundancy feature that increases the safe mechanical operation of such aircraft. Accordingly, the servo actuators 2, 3 may be operated simultaneously or alternatively to effect such position control function and preferably each is capable of properly effecting such function independently of the other so that control is maintained even when one of the servo actuators fails and/or is shut down. The servo actuators 2, 3 preferably are identical and, accordingly, only the former will be described in detail below, although it will be understood that such description similarly applies to the latter.

Figure 2:
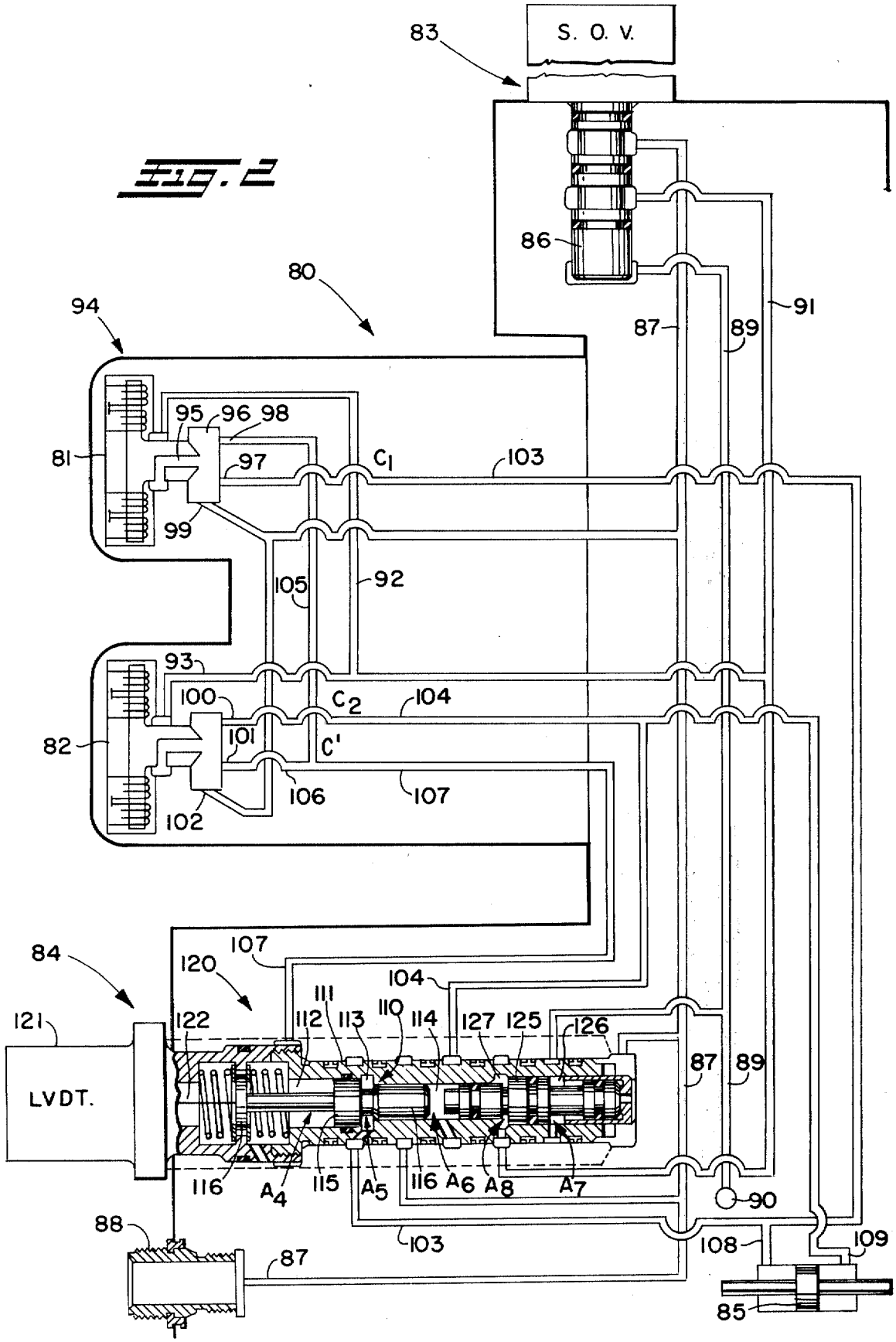
FIG. 2 is a schematic fluid circuit diagram of one servo actuator part of a modified redundant system including another embodiment of fault detector.

The servo actuator 2 includes a pair of servo valves 9, 10, such as conventional EHV's, also shown schematically at 81, 82 in FIG. 2, coupled for parallel electrical energization by the electronic control 5 to produce opposite fluid signal outputs $C_1$, $C_2$ to effect, respectively, extension or retraction of the output device 4. More particularly, the EHV 9 has an input port 11 and a pair of output ports 12, 13, as is conventional, but in this case only the port 12 (hereinafter the active output port) is coupled to deliver an active fluid output signal $C_1$ to control position of the output device 4 whereas the port 13 (hereinafter designated the passive output port) provides a passive fluid signal that is monitored to determine the condition of the servo actuator 2. The EHV 10 similarly has an input port 14, an active output port 15, and a passive output port 16. The active output port 15 is coupled to provide its active output signal $C_2$ for position control of the output device 4, and the passive output port 16 is connected together with the passive output port 13 at a combined passive output line 17 to provide a combined passive fluid signal C′ as an input to an hydraulic monitor fault detector 18, which will be described further below.

Hydraulic fluid supply signal 19 (note that gaseous fluid or other fluids could be equivalently used in the system 1) is provided the servo actuator 2 from a conventional supply source 20, for example at 3,000 pounds per square inch (psi). When the servo actuator 2 is operating or on, a solenoid operated shut-off valve 21 is energized by the electronic control 5 to deliver such supply signal to the input ports 11, 14 of the EHV's 9, 10. Moreover, the electronic control 5 provides an electronic control signal to torque motors, not shown, in the respective EHV's 9, 10, to move deflector plates 22, 23 therein in conventional manner, thereby to control the flow of hydraulic fluid from the input ports to the respective output ports thereof.

As is illustrated, the EHV's 9, 10 are connected in true electrical parallel so that the deflector plates thereof operate in the same direction in response to, for example, a given polarity control signal input, but the output ports of the EHV's are relatively oppositely connected. Therefore, for example, a maximum value control signal of one polarity may cause the EHV 9 to deliver a maximum active fluid signal $C_1$ to its active output port 12 and a minimum passive fluid signal to its passive output port 13, whereas such control signal would similarly cause the EHV 10 to deliver a minimum active fluid signal $C_2$ to its active output port 15 but a maximum passive fluid signal to its passive output port 16. An opposite signed control signal, for example, will cause the opposite operation of the EHV's 9, 10. Thus, the EHV's 9, 10 ordinarily operate in a substantially identical manner but with their active outputs connected to cause opposite operation of the output device 4, and the pressure of the combined passive fluid signal C′ in line 17 should remain approximately constant varying only directly proportionally with respect to the pressure of the supply source 20.

A common return flow line 24 from respective return ports of the EHV's 9, 10 couples the same to a return source or reservoir of hydraulic fluid indicated at 25. Such return source 25 may be pressurized, for example, to about 85 psi.

An active output line 26 couples the active output port 12 to an extend chamber 27 formed in a housing 28 behind a control piston or spool 29 of the output device 4, and an active output line 30 fluidically couples the active output port 15 to a retract chamber 31 in the housing 28 on the opposite side of the piston 29. A connecting rod 32 connects the piston 29 to a similar piston 33 in a similar housing 34 associated with the servo actuator 3.

When the solenoid operated shut-off valve 21 is on and the EHV's 9, 10 are electrically controlled by the electronic control 5 to produce an active fluid signal $C_1$ on active output line 26 that has a larger flow and/or pressure than the active fluid signal $C_2$ on active output line 30, the piston 29 will be urged, for example, toward an extend position, i.e. toward the right relative to FIG. 1. Such piston movement enlarges the extend chamber 27, which receives an additional quantity of the active fluid signal $C_1$ and reduces the size of the retract chamber 31 from which a quantity of the fluid therein is urged through the active output line 30 into the EHV 10 for return via line 24 to the return source 25. Such operation of the servo actuator 2 to move the piston 29 effects corresponding position control movement of the external device coupled to the output rod 6. Similar operation of the servo actuator 2 may be effected to produce an active fluid signal $C_2$ of greater magnitude than active fluid signal $C_1$ to cause retraction, i.e. leftward movement, of the piston 29, connecting rod 32, output rod 6, and the external device.

It will be appreciated that although the two servo actuators 2, 3 preferably are commonly electronically controlled, they are otherwise independently operable and, therefore, provide effective redundancy to assure proper control of the external device.

To determine the operative condition of the servo actuator 2, the fault detector 18 compares the pressure of the combined passive fluid signal C′ in line 17 with the pressures of two other fluid signals in the servo actuator 2. More particularly, in the embodiment illustrated in FIG. 1, the other two fluid signals are those of the supply signal from supply source 20 and of the return signal from return source 25. Accordingly, the detector 18 includes a sensor piston spool 40, which is movable in a housing 41 in response to forces created by the respective monitored fluid pressures in housing chambers 42, 43, 44, a rod 45, and a linear variable differential transformer (LVDT) 46, which is connected to the spool 40 by the rod 45 and produces a condition signal indicative of the spool position and, thus, of the servo actuator 2. The condition signal is delivered by electrical line 47 to the electronic control 5.

The net surface area $A_1$ of the spool 40 is exposed to fluid pressure in the chamber 42. The force $F_1$ produced on the spool 40 in response to fluid pressure in the chamber 42 tends to urge the spool axially to the right relative to the illustration of FIG. 1. At the same time fluid pressure in chamber 43 provided from the supply source 20 by a supply pressure monitor line 50 acts on a surface area $A_2$ of a piston extension 51 of the spool 40 to create a force $F_2$ tending to urge the latter to the left. Additionally, fluid pressure supplied to chamber 44 by return pressure monitor line 52 from the hydraulic fluid return source 25 acts on surface area $A_3$, which is equal to the difference in the cross-sectional surface area of a piston 53 and of the piston extension 51, creating a further force $F_3$ on the spool 40 tending to urge the latter to the left.

A detented spring mechanism 54 urges the sensor piston spool 40 to a neutral position in the housing and produces a threshold force level that must be exceeded by the force differential on the sensor piston spool 40 in order to obtain axial movement of the latter. Such threshold force level, for example, compensates for expected pressure variations and losses in the servo actuator 3. Accordingly, the signed combination of the three forces $F_1$, $F_2$, and $F_3$ applied at respective surface areas $A_1$, $A_2$, $A_3$ must exceed such threshold force level in order to cause the sensor piston spool 40 to move in the housing 41. Such movement by a minimum predetermined amount of, for example, a small fractional part of an inch, say 1/16 inch, ordinarily would be indicative of a faulty condition in the servo actuator 2 that is accordingly transduced by the LVDT 46 as a fault condition signal. In response to such fault condition signal, the electronic control 5 may include a turn-off circuit that de-energizes the solenoid operated shut-off valve 21, thereby disabling the faulty servo actuator 2. However, as long as the sum of the fluid created forces on the sensor piston spool 40 does not exceed the threshold force level of the detented spring mechanism 54, the spool will remain in its neutral position in the housing 41, and the LVDT 46 will produce a condition signal that indicates a satisfactory operation of the servo actuator 2.

The detented spring mechanism 54 includes a pair of springs 55, 56 that bear against respective walls of the housing 41 and against respective washers 57, 58 which are stopped by a circumferential stop 59. A plate 60, which is attached by a rod 61 to the sensor spool 40, ordinarily is trapped between the washers 57, 58 by the springs 55, 56 and/or by the fluid forces acting on the spool in centered position aligned with the stop 59. Clearance is provided so that fluid pressure is the same on both sides of plate 60. When the indicated signed combination of forces exceeds the threshold level of one of the springs 55, 56, the spool 40 will move and the plate 60 will move against one washer to compress its spring and will move away from the other washer.

The detector 18 also includes a fluid bypass mechanism that is operative to reduce failure transients in the servo actuator 2. A bypass line 66 couples the active fluid signal $C_1$ to a bypass port 67 in the housing 41, such bypass port ordinarily connecting with a chamber 68 between the two pistons 53, 62 of the sensor piston spool 40. Another bypass line 69 couples the active fluid signal $C_2$ to a pair of bypass ports 70, 71 and associated annuluses in the housing 41 aligned with such pistons 53, 62 and ordinarily blocked thereby when no fault condition has been detected.

In the event of a failure in the servo actuator 2, for example whereby the deflector plate 22 of the EHV 9 goes hard over to the left causing an excessive pressure of the active fluid signal $C_1$ and a substantial decrease in the ordinarily constant pressure of the combined passive fluid signal C′, the sensor piston spool 40 will be forced hard over to its left position whereupon the chamber 68 provides a flow path to relieve pressure from the active output line 26 via the bypass line 66, bypass port 67, and bypass port 70 to the bypass line 69. Such excess fluid pressure then can be returned through the active output port 15 of the EHV 10 and return line 24 to the return source 25. Accordingly, such failure would not substantially affect the output device 4, especially since the LVDT 46 ordinarily would promptly produce a fault condition signal that would cause the electronic control 5 to shut down the servo actuator 2 upon occurrence of such fault.

It is, of course, important to be able to check out the roper operation of the fault detector 18 to be sure of its bility to monitor accurately the operation of the servo ctuator 2. In accordance with the embodiment illustated in FIG. 1, such check out can be readily accomlished by deliberately de-energizing the solenoid operted shut-off valve 21 to block fluid pressure to the EHV's 9, 10, whereupon the supply signal pressure rom the supply source 20 acting against the surface $A_2$ f the piston extension 51 forces the sensor piston spool 0 to a hard over left position. Such positioning of the ensor piston spool 40 causes the LVDT 46 to produce proper fault condition signal on condition line 47, thus ndicating the proper operation of the hydraulic moni- or in a facile manner.

In view of the foregoing, it will be appreciated that uring normal operation of the servo actuator 2, the use f the passive output signals in the detector 18 for moni- oring the condition of the servo actuator and the dead nding of such signals in the detector 18 will not load ne servo actuator to any appreciable extent. Moreover, ny such loading ordinarily would be maintained contant since the pressure of the combined passive fluid ignal C′ ordinarily remains constant. Therefore, the use f plural such monitors in the respective servo actuators f the redundant system 1 will provide equivalent moni- oring effect throughout the system.

Turning now more particularly to FIG. 2, a modified ervo actuator 80 used with a similar parallel servo ctuator, not shown, in a redundant multiple channel ervo actuator system for position control of an output evice as described above with reference to FIG. 1, ncludes a pair of EHV's 81, 82, a solenoid operated hut-off valve 83, and an hydraulic monitor fault detec- or 84. An output piston 85 is part of the output device ontrolled by the servo actuator as described above imultaneously or alternately with the mentioned paral- el redundant servo actuator.

The solenoid operated shut-off valve 83, which may e electrically energized and de-energized by an elec- tronic control 5 (FIG. 1) as described above, includes a ovable spool 86. A return line 87 provides return ignal pressure, say at 85 psi, to the servo actuator 80 rom an hydraulic fluid return source, not shown, cou- led to an input fitting 88, and a pressure line 89 pro- ides supply signal pressure from the hydraulic fluid upply source, not shown, coupled to a connection 90. When the solenoid operated shut-off valve 83 is de- nergized, the spool 86 permits a fluid connection be- ween the return line and the system supply line 91 roviding return signal pressure throughout the servo ctuator 80 and maintaining the same effectively de- nergized. However, when the solenoid operated shut- ff valve 83 is energized, the spool 86 provides a con- ection between the pressure line 89 and the system upply line 91 to provide via input lines 92, 93 a supply f pressurized hydraulic fluid to the EHV's 81, 82.

The EHV 81 includes an electromagnetic operating nechanism 94, for example including a plurality of coils hat are separately or simultaneously energized by the lectronic control 5 to effect movement of a deflector late or jet 95 relative to a chamber 96 and active output ort 97 and passive output port 98. The return line 87 is onnected to a return output port 99 of the EHV 81. The EHV 82 is similar in construction and operation to he EHV 81 and includes active output port 100, passive utput port 101, and return output port 102. Accordngly, the EHV's 81, 82 preferably are operated, as described above, in parallel manner to provide respective active and passive fluid signals in active output lines 103, 104 and passive output lines 105, 106, the latter two lines being combined to provide a combined passive fluid signal C′ in a combined passive output line 107.

The active output lines 103, 104 are coupled at respective connections 108, 109 to the output device at piston 85 to effect position control thereof. Thus, as the servo actuator 80 is electrically operated, for example by an electronic control 5 as described above, such position control is effected. Simultaneously, the hydraulic monitor fault detector 84 monitors the condition of the servo actuator 80.

In the embodiment illustrated in FIG. 2, the fault detector 84 compares the pressure of the combined passive fluid signal C′ with fractional amounts of the pressures of the respective active fluid signals $C_1$ and $C_2$.

The fault detector 84 includes a sensor piston spool 110 movable in a housing 111 forming respective chambers 112, 113, 114 therein. As above, the pressure of the combined passive fluid signal C′ in chamber 112 acts on a net surface area $A_4$ of a piston 115 and plate 116 associated with the sensor piston spool 110 applying a force tending to urge the latter axially to the right relative to the illustration of FIG. 2. Simultaneously, the pressure of the active fluid signal $C_1$ is applied via line 103 to chamber 113 acting on the net surface area $A_5$ of piston 115 tending to urge the spool 110 to the left, and pressure of the active fluid signal $C_2$ in line 104 acts on an exposed surface area $A_6$ of piston 116 of the spool 110 also tending to urge the latter to the left.

In the preferred form of the embodiment illustrated in FIG. 2, the surface area $A_5$ equals the surface area $A_6$ and the sum of the two equals the surface area $A_4$. These convenient relationships are possible because the EHV's preferably work in parallelly opposite relation so that the sum of the pressures of the active output signals $C_1$ and $C_2$ should equal the pressure of the combined passive signal C′. As above, when the signed sum of the pressure created forces on the spool 110 equals zero, the spool will be maintained in a neutral position by a detented spring arrangement 120, which also provides a threshold force level. When the signed sum of the forces on spool 110 exceeds that threshold force level, the spool 110 will move axially in the housing 111, and such motion will be sensed by an LVDT 121, which is coupled by a connecting rod 122 to the spool and, accordingly, produces a fault condition signal, as above. Such fault condition signal may be employed to shut down the servo actuator 80 by the electronic control 5 and/or to effect start-up of a similar servo actuator coupled in the overall redundant system in common with the servo actuator 80, as above.

To check out the operability of the hydraulic monitor fault detector 84, a check out piston 125 also is axially movably mounted in the housing 111. The pressure line 89 applies supply signal pressure directly from the hydraulic fluid supply source, not shown, and connection 90 to a chamber 126 and to the surface area $A_7$ of the check out piston 125 tending to urge the latter in a lefthand direction while the supply signal pressure from the system supply line 91 and solenoid operated shut-off valve 83 also is provided to a chamber 127 to act on a surface area $A_8$ of the check out piston tending to urge the same in a righthand direction. The net surface area $A_8$ is larger than the net surface area $A_7$; therefore, as long as the solenoid operated shut-off valve 83 is energized and proper fluid pressure is in each of the pressure line 89 and system supply line 91, the check-out piston 125 will remain in the righthand position illustrated in FIG. 2. However, upon de-energization of the solenoid operated shut-off valve 83 to remove the supply signal pressure from the system supply line 91, the pressure in line 89 and chamber 126 will drive the check out piston 125 to the left in turn driving the sensor piston spool 110 to the left against the force of the detented spring arrangement 120, whereupon the LVDT 121 produces a fault condition signal during such check out.

It will be appreciated that the servo actuator 80 may be employed with one or more additional such servo actuators in a redundant multiple channel servo actuator system coupled to respective control pistons of a common output device as in the system diagram illustrated in FIG. 1 to provide redundant control of such output device. Moreover, a particular advantage to the hydraulic monitor fault detector arrangement 84 in the servo actuator 80 is the ability to provide relatively accurate monitoring function even at extremely low temperatures, for the temperatures of the active and passive fluid signals will remain relatively equal so that the system is not temperature-dependent.

We, therefore, particularly point out and distinctly claim as our invention:

1. A monitor for monitoring the condition of a fluid system, comprising: a housing, sensor spool means movable in said housing and forming therewith plural respectively substantially fluidically isolated chambers for converting respective fluid pressures applied to said chambers from such system to representative forces, said spool means including plural surface areas exposed to fluid pressure in respective chambers in respective directions such that at least one of such forces opposes at least two of such forces tending to move said spool means to respective positions in said housing as an indication of the condition of such fluid system.

2. The monitor of claim 1, wherein the surface area against which one fluid pressure is applied to create said at least one of such forces equals the sum of the surface areas against which fluid pressures act to produce said at least two of such forces.

3. The monitor of claim 1, wherein said housing includes a first port to receive a first fluid that applies a first fluid pressure to a first surface area thereof to create said at least one of such forces and second and third fluidically isolated ports to receive, respectively, second and third fluids that apply pressures to second and third surface areas of said spool means to create said at least two of such forces.

4. The monitor of claim 3, further comprising means for coupling one of said second and third ports to receive the fluid supply signal of such fluid system, whereby upon shut down of such fluid system such fluid supply signal causes movement of said spool means to indicate a fault condition.

5. The monitor of claim 3, wherein each of said ports is fluidically coupled with a respective fluid chamber in said housing, said respective chambers being otherwise substantially fluidically isolated, whereby the monitor is substantially non-loading of such system.

6. The monitor of claim 1, further comprising a linear variable differential transformer coupled to said spool means to provide an output electrical signal indicative of the position of the latter.

7. The monitor of claim 1, further comprising bypass means for effecting a fluid bypass connection through said housing and said spool means upon the detection of a fault condition in such system.

8. The monitor of claim 1, further comprising detent spring means for urging said spool means to a relatively neutral position in said housing and providing a net threshold force level for effecting movement of said spool means in said housing.

9. The monitor of claim 8, wherein said detent spring means comprises a bearing surface coupled to said spool means and positioned in one of said chambers, and spring means positioned to bear against said bearing surface and walls of said housing on opposite sides of said bearing surface for urging the latter and said spool means to such neutral position.

10. The monitor of claim 9, wherein said bearing surface comprises a plate and said spring means comprises two springs, respectively, on each side of said plate.

11. The monitor of claim 1, further comprising check out piston means for moving said spool means to a position indicative of a fault condition in response to shut down of such fluid system.

12. A method of monitoring the condition of a fluid system including system input fluid supply signal pressure, system fluid signal return pressure, and at least one servo actuator including at least two servo valves for controllably delivering active fluids signals to an external device for controlling the same and passive fluid signals, comprising comparing the pressure of a combination of the passive fluid signals from such valves to the pressures of at least two other fluids in such servo actuator, and producing a discernable output indicative of a predetermined condition of such servo actuator when the results of such comparison exceeds a predetermined threshold level.

13. The method of claim 12, wherein said step of comparing comprises comparing the pressure of such combination of passive fluid signals with the pressure of such supply signal and the pressure of such return signal.

14. The method of claim 12, wherein said step of comparing comprises comparing the pressure of such combination of passive fluid signals with the pressure of one active fluid signal produced by one of such valves and the pressure of another active fluid signal from another of such valves.

15. The method of claim 12, wherein said step of comparing comprises converting the pressure of such combination of passive fluid signals to a first force and the pressures of such at least two other fluids to respective forces that are directed oppositely from such first force, and vectorially combining such forces to determine whether such combination thereof exceeds a predetermined threshold level.

16. The method of claim 12, further comprising the step of bypassing the larger of such active fluid signals to connection with the smaller of such active fluid signals when the results of such comparison exceed such predetermined threshold level.

17. A multiple channel servo system for controlling an output device, comprising: a servo actuator including plural servo valve means for controllably delivering fluid to such output device to control the same, each servo valve means having a fluid input port, an active output port, and a passive output port, control means for controlling fluid flow in each servo valve means from said input port to said active and passive output ports as respective active and passive fluid signals, and oupling means for fluidically coupling said active out-ut ports to such output device respectively to effect elatively opposite response of the latter; and fluid mon-or means for detecting the condition of said servo ctuator and including detector means for simulta-eously comparing the pressure of a combination of ıch passive fluid signals with the pressures of at least wo other fluid signals in said servo actuator to deter-ıine the condition thereof.

18. The system of claim 17, further comprising a econd servo actuator similar to the first mentioned ervo actuator and redundantly coupled therewith to ontrol such output device, and a second fluid monitor ıeans similar to the first mentioned fluid monitor means or detecting the condition of said second servo actua-or.

19. The system of claim 17, wherein said fluid moni-or means comprises a housing, sensor spool means ıovable in said housing and forming therewith plural espectively substantially fluidically isolated chambers or converting respective fluid pressures applied to said hambers from said servo actuator to representative orces, said spool means including plural surface areas xposed to respective chambers in respective directions uch that at least one of such forces opposes at least two f such forces tending to move such spool to respective ositions in said housing indicative of the condition of aid servo actuator.

20. The system of claim 19, further comprising means or coupling fluid supply and fluid return signals to said ervo valves, and wherein said housing includes a first ort coupled to said servo valves to receive such combi-ation of passive fluid signals that applies a first fluid ressure to a first surface area thereof to create said at east one of such forces and second and third fluidically olated ports coupled to receive, respectively, such luid supply and fluid return signals that apply pressures o second and third surface areas of said spool means to reate said at least two of such forces.

21. The system of claim 20, wherein said means for oupling comprises a valve, and further comprising luid conduit means for delivering such fluid supply ignal to said second surface area independently of said alve, whereby upon shut down of said valve to cut off luid supply signal from said servo valves, such fluid upply signal causes movement of said spool means to ndicate a fault condition.

22. The system of claim 19, wherein said housing ncludes a first port coupled to said servo valves to receive such combination of passive fluid signals that applies a first fluid pressure to a first surface area thereof to create said at least one of such forces and second and third fluidically isolated ports coupled to said servo valves to receive, respectively, such active fluid signals that apply pressures to second and third surface areas of said spool means to create said at least two of such forces.

23. The system of claim 22, further comprising fluid supply means for supplying a supply fluid signal, valve means for delivering such supply fluid signal to said servo valves, fluid conduit means for delivering such supply fluid signal to said monitor means independently of said valve means, and said monitor means further comprising check out piston means for moving said spool means to a position indicative of a fault condition in response to shut down of said valve means to cut off fluid supply signal from said servo valves.

24. The system of claim 19, wherein said housing includes a first port coupled to said servo valves to receive such combination of passive fluid signals that applies a first fluid pressure to a first surface area thereof to create said at least one of such forces and second and third fluidically isolated ports coupled to said servo valves to receive, respectively, second and third fluids that apply pressures to second and third surface areas of said spool means to create said at least two of such forces, each of said ports being fluidically coupled with a respective fluid chamber in said housing, and said respective chambers being otherwise fluidically isolated, whereby the monitor is substantially non-loading of said servo actuator system.

25. The system of claim 19, wherein said servo actuator includes valve means for controllably supplying a supply fluid signal to said servo valves, and said monitor means further comprises a linear variable differential transformer coupled to said spool means to provide an output electrical signal indicative of the position of the latter and to effect operation of said valve means to cut off such supply fluid signal upon movement of said spool means to a position indicative of a detected fault.

26. The system of claim 19, further comprising bypass means for effecting a fluid bypass connection between said active output ports through said housing and said spool means upon the detection of a fault condition in such system.

27. The system of claim 19, wherein said servo valves are electro hydraulic servo valves.

* * * * *